US012672741B1

(12) United States Patent
Liu

(10) Patent No.: US 12,672,741 B1
(45) Date of Patent: Jul. 7, 2026

(54) ICE-MAKING INTELLIGENT BATHTUB

(71) Applicant: Shenzhen Bropool Industrial Co., Ltd., Shenzhen (CN)

(72) Inventor: Haihui Liu, Shenzhen (CN)

(73) Assignee: SHENZHEN OMNI ICE TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 19/367,163

(22) Filed: Oct. 23, 2025

(51) Int. Cl.
*A47K 3/00* (2006.01)
*F25C 1/25* (2018.01)

(52) U.S. Cl.
CPC ..... *A47K 3/001* (2013.01); *F25C 1/25* (2018.01); *F25C 2400/12* (2013.01); *F25C 2600/02* (2013.01); *F25C 2600/04* (2013.01); *F25C 2700/14* (2013.01)

(58) Field of Classification Search
CPC ..... A47K 3/001; A47K 3/00; A61H 33/00
See application file for complete search history.

(56) References Cited

U.S. PATENT DOCUMENTS 8,453,275 B2 * 6/2013 May ..... A61H 33/005 4/507
2020/0009012 A1 1/2020 Izumitani
2022/0079389 A1 3/2022 Fang et al.
2024/0016342 A1 1/2024 Chen

FOREIGN PATENT DOCUMENTS

CN 102734926 A * 10/2012

* cited by examiner

*Primary Examiner* — Lionel Nouketcha
(74) *Attorney, Agent, or Firm* — Hemisphere Law, PLLC

(57) ABSTRACT

The present disclosure discloses an ice-making intelligent bathtub to solve the problem that the ice-making mechanism in the prior art is single and has no automatic heating and deicing function. The ice-making intelligent bathtub makes ice through a heat exchanger connected in parallel to an S-shaped flattened wall-attached D-shaped copper tube, and during heating, an electromagnetic value cuts off a copper tube passage; in an ice-making stage, the water temperature in a liner can be quickly decreased to stably form an ice layer on a liner wall, guaranteeing a durable low temperature of a cold bath, and compared with a single refrigerating system, the ice-making efficiency is significantly improved; in a deicing stage, the heat exchanger heats mildly to prevent a polyurethane insulation layer from being damaged by a high temperature of the wall-attached D-shaped copper tube, such that the service life of the device is prolonged.

10 Claims, 8 Drawing Sheets

ICE-MAKING INTELLIGENT BATHTUB

BACKGROUND OF THE INVENTION

Technical Field

The present disclosure relates to the technical field of bathtubs, and in particular to, an ice-making intelligent bathtub.

Description of Related Art

An authorized Chinese patent publication No. CN221474601U discloses an ice bath refrigeration bathtub, including a bathtub main body, a top cover, and a refrigerating system, where the top cover covers an upper opening of the bathtub main body to seal an immersion area of the bathtub; and the bathtub main body includes a stainless steel liner, a shell, and a thermal insulation layer. A user only needs to pour an appropriate amount of water into the bathtub. Before exercise, the user starts the refrigerating system to work, and after exercise, the user can perform an ice water immersion bath to achieve the effect of relieving muscles.

Aiming at the above and existing related arts, the inventor believes that there are the following defects: this device only makes ice by matching a single refrigerating heat exchange tube in a pipeline groove on the outer wall of the stainless steel liner with a refrigerating system formed by "compressor-condenser-throttle-evaporator". The ice-making mechanism is single, and the efficiency is limited. A water body forms an ice-water mixture only through indirect heat exchange between the heat exchange tube and the liner, and an ice layer cannot be stably formed on the inner wall of the liner to meet a long-term cold bath requirement, and an auxiliary design of improving the ice-making efficiency is short. Moreover, a corresponding heating and deicing mechanism is not arranged in this solution, and the formed ice layer needs to be cleaned manually, such that the operation is tedious and the surface of the liner is easily damaged in the cleaning process.

BRIEF SUMMARY OF THE INVENTION

To solve the technical problem that the ice-making mechanism in the prior art is single and has no automatic heating and deicing function, the present disclosure provides an ice-making intelligent bathtub.

In order to achieve the above objective, this application adopts the following technical solution: an ice-making intelligent bathtub includes a shell, where a liner is embedded at one side of a top end of the shell, a wall-attached D-shaped copper tube is adhered to an outer wall of the liner, an electromagnetic valve is mounted at one end of the wall-attached D-shaped copper tube, a mounting chamber is arranged on one side inside the shell away from the liner, a compressor is mounted inside the mounting chamber, the compressor is communicated to a port D in a four-way valve tube through a pipeline, a port S in the four-way valve tube is communicated to a return flow port of the compressor through a pipeline, a port C of the four-way valve tube is communicated to an air-cooled condenser through a pipeline, the air-cooled condenser is communicated to a capillary tube through a pipeline, the capillary tube is communicated to a heat exchanger through a pipeline, the heat exchanger is communicated to a port E in the four-way valve tube through a pipeline, the heat exchanger and the wall-attached D-shaped copper tube are arranged in parallel, a water outlet pipe is communicated to a bottom end on one side of the liner close to the mounting chamber, a hairnet-type filter is mounted on the water outlet pipe, a mounting box is mounted on an outer side of the liner above the water outlet pipe, a fog discharge port and a water inlet are respectively formed in an inner side of the mounting box, a water circulation system is arranged inside the mounting chamber to communicate with the fog discharge port, the water inlet, and the water outlet pipe, the water circulation system is connected in series to water inlet and outlet ends of the heat exchanger, a water temperature sensor is embedded into the middle of the inner wall on one side of the liner close to the mounting chamber, a controller is mounted on an outer side of the shell, and the controller is in signal connection to the water temperature sensor, the water circulation system, the compressor, the four-way valve tube, the air-cooled condenser, the heat exchanger, and the electromagnetic valve.

Preferably, the wall-attached D-shaped copper tube is uniformly distributed in an S shape on the outer wall of the liner, and a section of the wall-attached D-shaped copper tube is D-shaped and a flattened surface of the wall-attached D-shaped copper tube fits with the liner.

Preferably, a drain pipe is arranged at a bottom end of the liner, one end of the drain pipe extends to an exterior of the shell, and a cavity between the shell and the liner is filled with an insulation material.

Preferably, the insulation material is polyurethane foam.

Preferably, a timer is arranged inside the controller for delayed operation of the compressor, and when a water temperature detected by the water temperature sensor is less than or equal to 3° C., the compressor enters a delayed state.

Preferably, the four-way valve tube and the electromagnetic valve are in signal linkage; in an ice-making state, a refrigerant flows from a port D to a port C in the four-way valve tube and from a port E to a port S, and the electromagnetic valve is opened; and in a deicing state, the refrigerant flows from the port D to a port E in the four-way valve tube and from a port C to a port S, and the electromagnetic valve is closed.

Preferably, the water circulation system includes a water pump and an auxiliary pump mounted inside the mounting chamber, the water pump and the auxiliary pump are connected in series, a water inlet end of the auxiliary pump is communicated to the water outlet pipe, a water outlet end of the water pump is communicated to a secondary filter through a pipeline, a water outlet end of the secondary filter is communicated to a water inlet end of the heat exchanger, a water outlet end of the heat exchanger is communicated to an ultraviolet disinfection lamp through a pipeline, a water outlet end of the ultraviolet disinfection lamp is communicated to a three-way tube, one end of the three-way tube is communicated to the water inlet through an ozone generator, and the other end of the three-way tube is communicated to the fog discharge port through a fog generator.

Preferably, a flowmeter is arranged in a pipeline at the water outlet of the water pump, and the flowmeter is in signal connection to the controller.

Preferably, the fog generator is fixed in a groove inside the mounting box, the groove is communicated to an interior of the liner, and the groove is located below a water line.

Preferably, an indicator lamp is mounted on the inner wall of the liner below the mounting box, and the indicator lamp is in signal connection to the controller.

The present disclosure has the following technical effects and advantages:

In the present disclosure, through the refrigerant circulation design of "dual system refrigeration+single system heating", i.e., the heat exchanger is connected in parallel to the S-shaped flattened wall-attached D-shaped copper tube, during heating, the electromagnetic value cuts off the copper tube passage; first, in the ice-making stage, the water temperature in the liner can be quickly decreased to stably form the ice layer on the liner wall, guaranteeing the durable low temperature of the cold bath, and compared with the single refrigerating system, the ice-making efficiency is significantly improved; second, in the deicing stage, the heat exchanger heats mildly to prevent the polyurethane insulation layer from being damaged by a high temperature of the wall-attached D-shaped copper tube, such that the service life of the device is prolonged; in combination with the "two-stage filtering+dual pump linking" water circulation system, the water circulation system matches ultraviolet and ozone disinfection, and ultrasonic fog generation functions, such that the water quality safety is guaranteed, and ice-making is accelerated by virtue of atomization cooling. Moreover, the indicator lamp displays the operating state in real time. The ice-making intelligent bathtub is practical and intelligent, and meets the requirements for cold bath, heating bath, and daily disinfection.

BRIEF DESCRIPTION OF THE SEVERAL VIEWS OF THE DRAWINGS

The disclosed content of the present disclosure is described with reference to drawings. It should be understood that the drawings are for a descriptive purpose only and are not intended to limit the protection scope of the present disclosure. In the drawings, the same numerals are used to indicate the same components.

Figure 1:
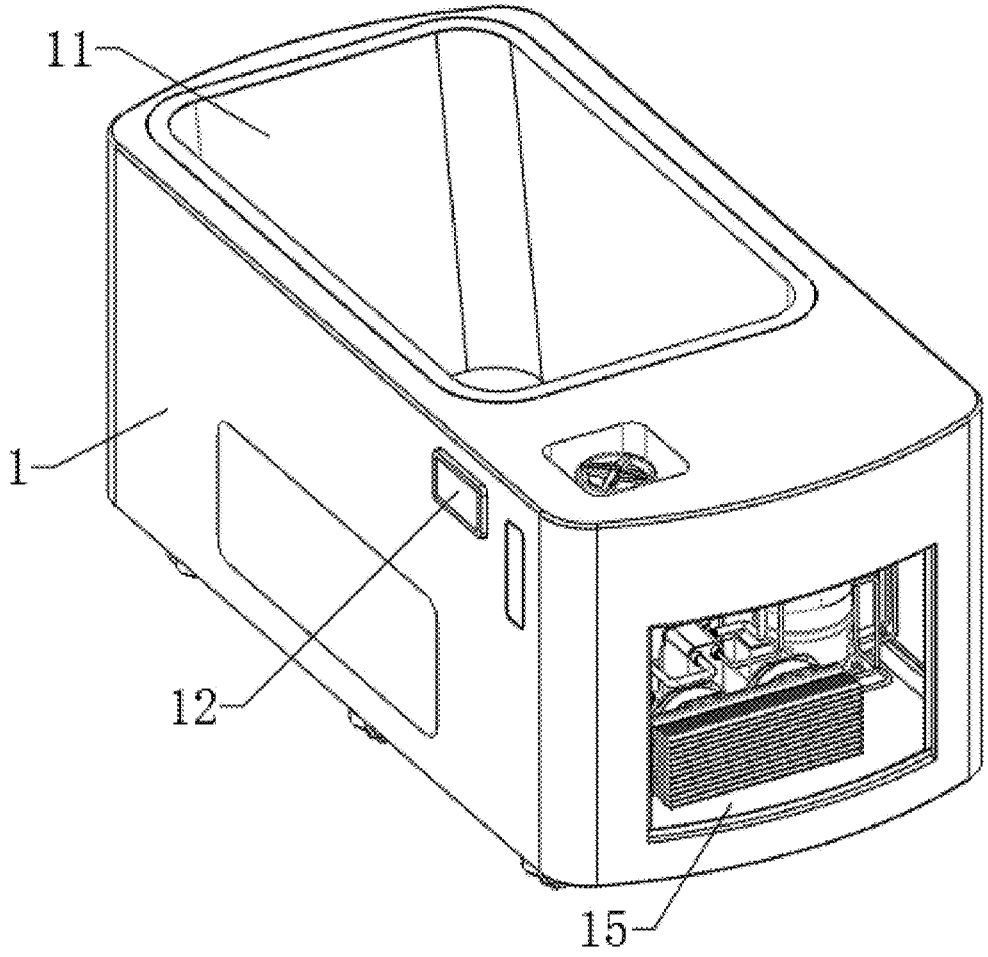
FIG. 1 is a three-dimensional schematic structural diagram of the present disclosure.

Numerals in the drawings: 1, shell; 11, liner; 12, controller; 13, insulation material; 14, water temperature sensor; 15, mounting chamber; 2, compressor; 21, four-way valve tube; 22, air-cooled condenser; 23, capillary tube; 24, heat exchanger; 25, electromagnetic valve; 26, wall-attached D-shaped copper tube; 3, water outlet pipe; 31, hairnet-type filter; 4, mounting box; 41, fog discharge port; 42, water inlet; 5, water circulation system; 51, water pump; 52, auxiliary pump; 53, secondary filter; 54, ultraviolet disinfection lamp; 55, three-way tube; 56, ozone generator; 57, fog generator; 6, indicator lamp.

DETAILED DESCRIPTION OF THE INVENTION

It will be readily understood that, according to the technical solution of the present disclosure, and without departing from the essential spirit of the present disclosure, those of ordinary skill in the art can propose a variety of mutually replaceable structural modes and implementation modes. Therefore, the following specific embodiments and the drawings are merely exemplary illustrations of the technical solution of the present disclosure, and shall not be regarded as the entirety of the present disclosure or as a limitation or restriction on the technical solution of the present disclosure.

Embodiment I: referring to FIGS. 1-4, FIG. 6, and FIG. 7, the present disclosure provides a technical solution: an ice-making intelligent bathtub includes a shell 1, where a liner 11 is embedded at one side of a top end of the shell 1, and edges of the two are sealed by a sealing rubber strip to prevent water seepage; a wall-attached D-shaped copper tube 26 is adhered to an outer wall of the liner 11, the wall-attached D-shaped copper tube 26 is tightly attached to the outer wall of the liner through a high-temperature-resistant heat-conducting glue without clearance contact to enhance heat transfer; an electromagnetic valve 25 is mounted at one end of the wall-attached D-shaped copper tube 26, and the electromagnetic valve 25 is fixed on a mounting boss on the outer side of the liner 11; a mounting chamber 15 is arranged on one side inside the shell 1 away from the liner 11, a compressor 2 is mounted inside the mounting chamber 15, and the compressor 2 is fixed at the bottom of the mounting chamber through a shock-absorbing pad, such that vibration transfer during operation is reduced; the compressor 2 is communicated to a port D in a four-way valve tube 21 through a pipeline, and the outer layer of the pipeline is wrapped with insulation cotton, such that the heat loss of the refrigerant is reduced; a port S in the four-way valve tube 21 is communicated to a return flow port of the compressor 2 through a pipeline, a port C of the four-way valve tube 21 is communicated to an air-cooled condenser 22 through a pipeline, the air-cooled condenser 22 is communicated to a capillary tube 23 through a pipeline, the capillary tube 23 is communicated to a heat exchanger 24 through a pipeline, the heat exchanger is communicated to a port E in the four-way valve tube through a pipeline, the heat exchanger 24 and the wall-attached D-shaped copper tube 26 are arranged in parallel, a water outlet pipe 3 is communicated to a bottom end on one side of the liner 11 close to the mounting chamber 15, a hairnet-type filter 31 is mounted on the water outlet pipe 3, a mounting box 4 is mounted on an outer side of the liner 11 above the water outlet pipe 3, a fog discharge port 41 and a water inlet 42 are respectively formed in an inner side of the mounting box 4, a water circulation system 5 is arranged inside the mounting chamber 15 to communicate with the fog discharge port 41, the water inlet 42, and the water outlet pipe 3, the water circulation system 5 is connected in series to water inlet and outlet ends of the heat exchanger 24, a water temperature sensor 14 is embedded onto the middle of the inner wall on one side of the liner 11 close to the mounting chamber 15, a controller 12 is mounted on an outer side of the shell 1, and the controller 12 is in signal connection to the water temperature sensor 14, the water circulation system 5, the compressor 2, the four-way valve tube 21, the air-cooled condenser 22, the heat exchanger 24, and the electromagnetic valve 25.

By matching the compressor 2 with the air-cooled condenser 22, the heat exchanger 24, and the like, the cooling and ice-making effect of a water flow in the liner 11 is achieved. Under the action of the heat exchanger 24, a flowing cooling effect on the water flow is achieved, such that uniform cooling of the water flow is improved. Matched with the cooling of the inner wall of the liner 11 by the wall-attached D-shaped copper tube 26, an icing effect is formed on the inner wall of the liner 11. The formation of an ice block is beneficial to guaranteeing a long-term low-temperature state of the water flow, thereby further ensuring the low-temperature property of the cold bath and greatly improving the cooling and ice-making efficiency. When controlled by the controller 12, the water flow in the liner 11 transforms between being cold and hot, which, on the one hand, facilitates melting removal of the ice layer, and the like, and on the other hand, meets the water bath requirements at different temperatures. Under on-off control of the electromagnetic valve 25, a dual-refrigerating and single-heating system for the water flow is formed to prevent the wall-attached D-shaped copper tube 26 from damaging the insulation material 13 in the inner cavity of the shell 1 during heating, thereby prolonging the service life of the bathtub.

Figure 4:
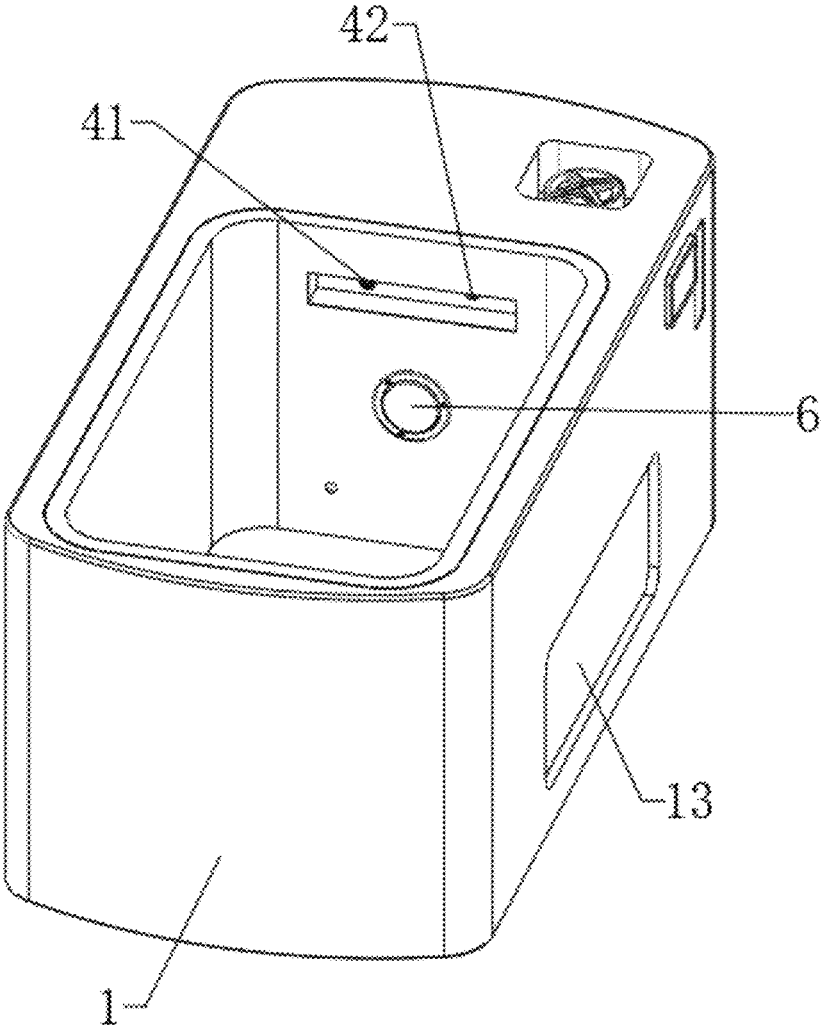
FIG. 4 is a three-dimensional schematic structural diagram of a shell of the present disclosure.
Figure 8:
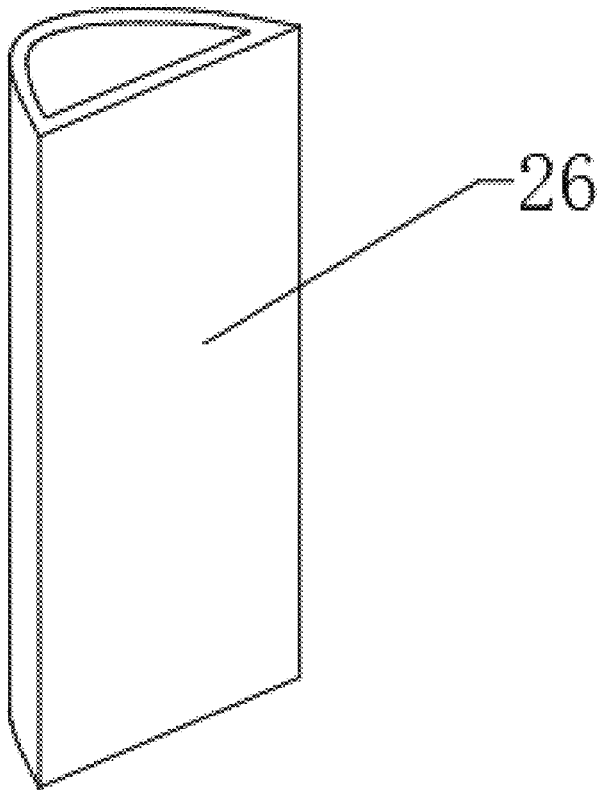
FIG. 8 is a three-dimensional schematic structural diagram of a section of the wall-attached D-shaped copper tube of the present disclosure.

Referring to FIG. 4 and FIG. 8, the wall-attached D-shaped copper tube 26 is uniformly distributed in an S shape on the outer wall of the liner 11, a section of the wall-attached D-shaped copper tube 26 is flattened-shaped, and a flattened surface of the wall-attached D-shaped copper tube fits with the liner 11.

S-shaped distribution improves the flow path of the refrigerant in the wall-attached D-shaped copper tube 26, such that the heat absorption range thereof is enlarged. Moreover, a cylindrical copper tube is heated and subjected to mold pressing by the hot-pressing forming technique to form a copper tube structure with a D-shaped section; by means of its flattened structure, the contact area between the wall-attached D-shaped copper tube 26 and the liner 11 is increased, such that the cooling and ice-making performance is improved. Moreover, the fitted installation stability between the wall-attached D-shaped copper tube 26 and the liner 11 is improved.

Figure 2:
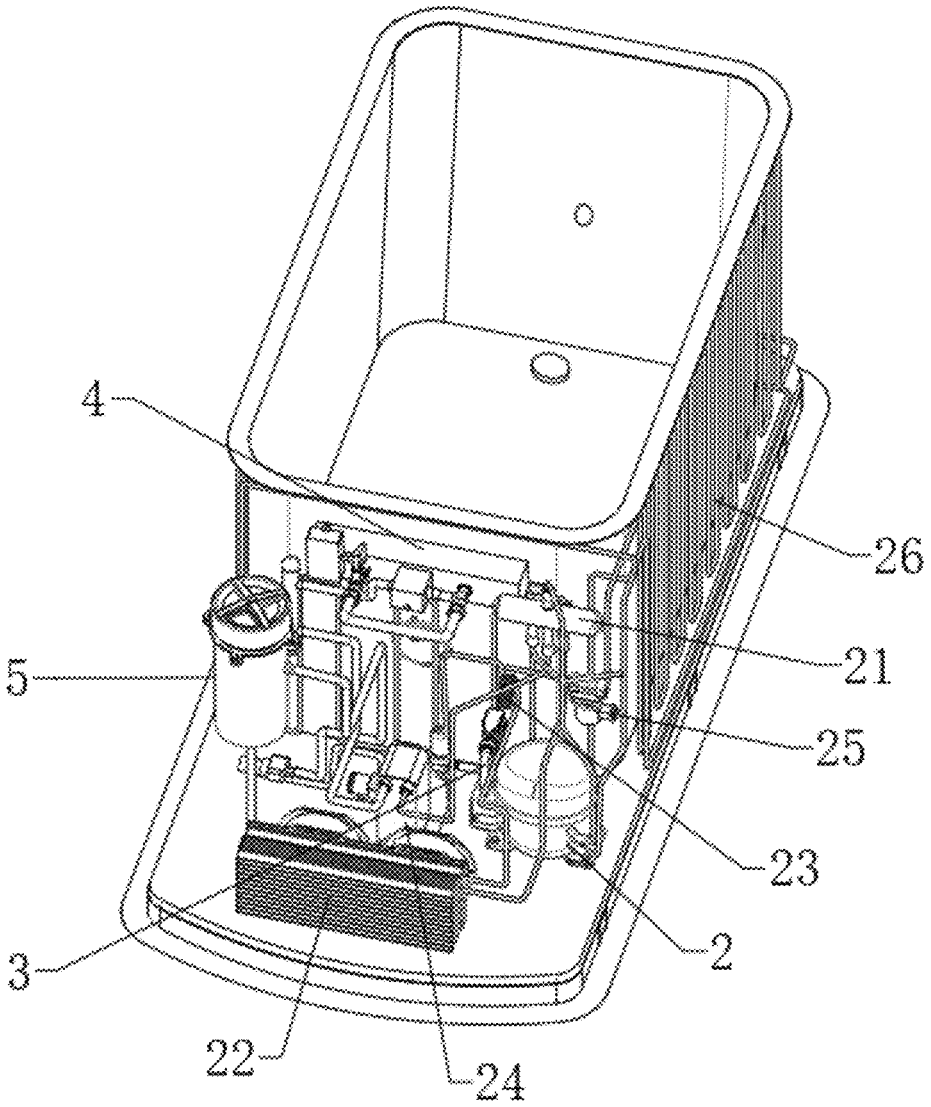
FIG. 2 is a three-dimensional schematic structure diagram inside a shell of the present disclosure.
Figure 3:
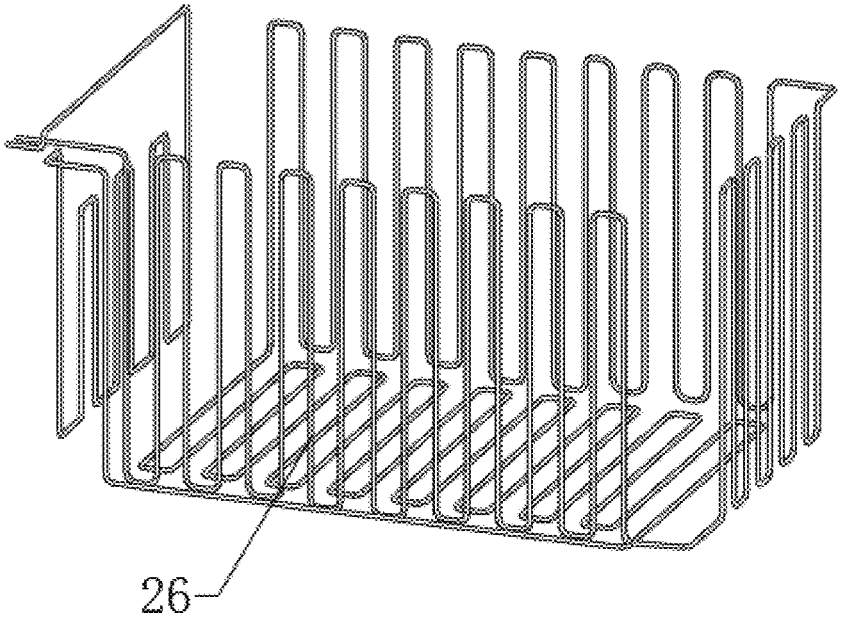
FIG. 3 is a three-dimensional schematic structure diagram of a wall-attached D-shaped copper tube of the present disclosure.

Referring to FIG. 2 and FIG. 4, a drain pipe is arranged at a bottom end of the liner 11, one end of the drain pipe extends to an exterior of the shell 1, and a cavity between the shell 1 and the liner 11 is filled with an insulation material 13.

The drain pipe and a corresponding sealing plug are used for normal drainage after the bathtub is used. The insulation material 13 improves the insulation performance of the bathtub and reduces heat exchange between the water flow in the liner 11 and external air.

Referring to FIG. 4, the insulation material 13 is polyurethane foam.

The insulation material 13 here wraps the outer wall of the liner 11. By means of the insulating performance of polyurethane, the arrangement safety of electric wires inside the shell 1 is improved. Moreover, the insulation material provides good insulation performance for the bathtub.

Referring to FIG. 1, a timer is arranged inside the controller 12 for delayed operation of the compressor 2, and when a water temperature detected by the water temperature sensor 14 is less than or equal to 3° C., the compressor 2 enters a delayed state.

By means of the effect of the timer, after the ice-making state, the delayed operation of the compressor 2 is controlled to automatically control the subsequent heating and deciding time according to the cold bath time of the user, such that the intelligence of the bathtub is improved. Moreover, in the delayed state, the refrigerant is endowed with sufficient heat exchange time, such that the ice layer is formed on the inner wall of the liner 11. The water temperature sensor 14 can control the time of the ice-making state according to the water temperature, so as to ensure that the water temperature state meets the bathing requirement when the cold bath starts.

Figure 6:
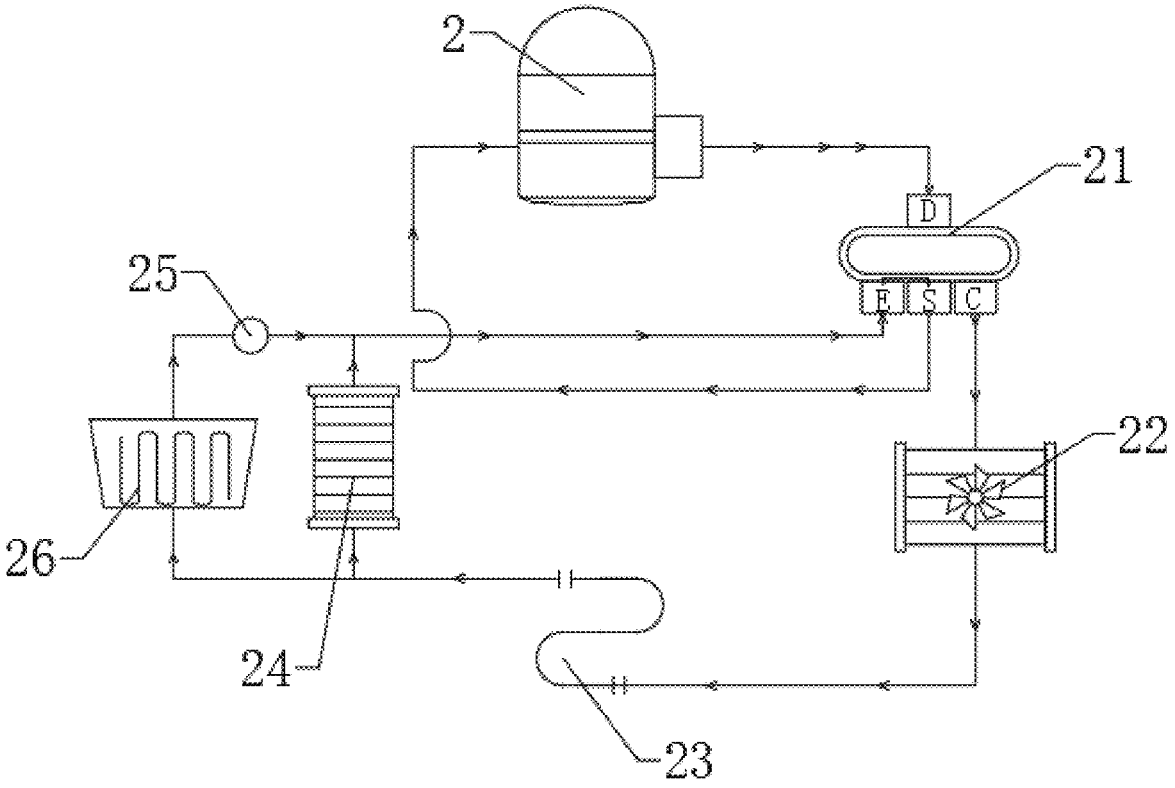
FIG. 6 is a schematic structural diagram of operation of an ice-making state of the present disclosure.
Figure 7:
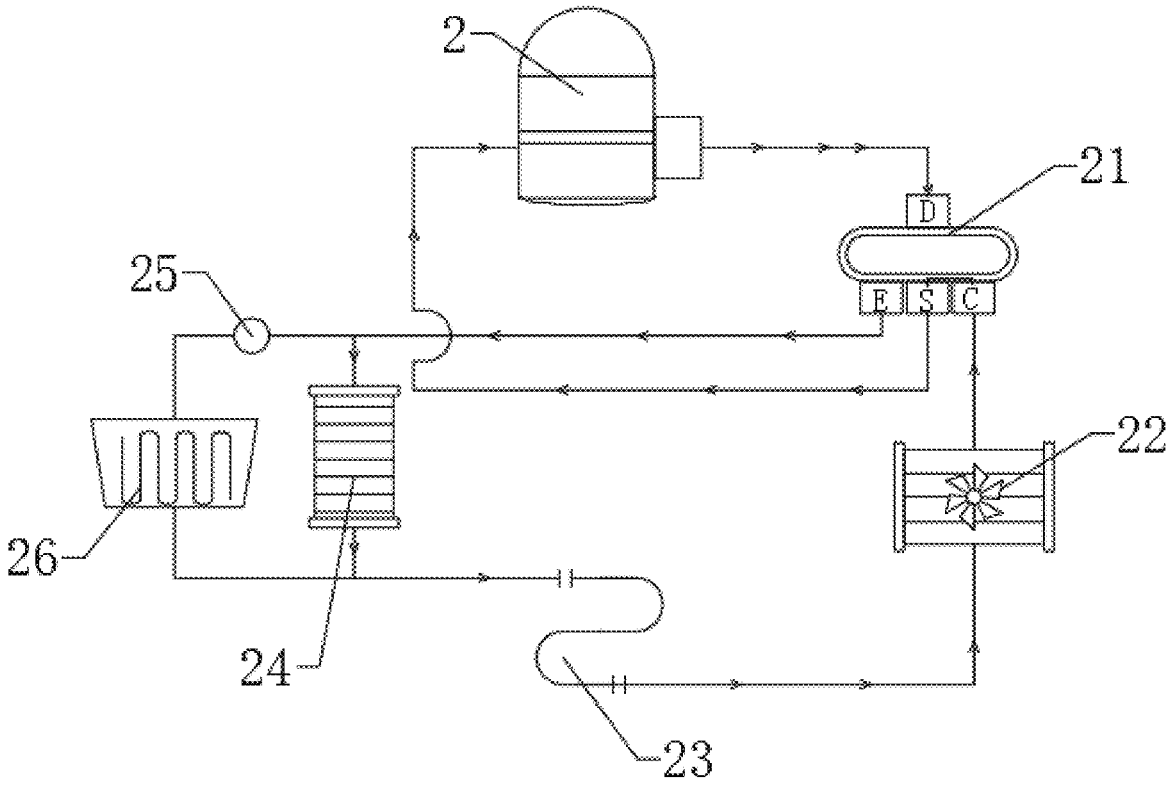
FIG. 7 is a schematic structural diagram of operation of a deicing state of the present disclosure.

Referring to FIG. 6 and FIG. 7, the four-way valve tube 21 and the electromagnetic valve 25 are in signal linkage; in an ice-making state, a refrigerant flows from a port D to a port C in the four-way valve tube 21 and from a port E to a port S, and the electromagnetic valve 25 is opened; and in a deicing state, the refrigerant flows from the port D to a port E in the four-way valve tube 21 and from a port C to a port S, and the electromagnetic valve 25 is closed.

By means of linkage of the four-way valve tube 21 and the electromagnetic valve 25, the four-way valve tube 21 serves as a main switch for state switching to directly control the opening and closing of the electromagnetic valve 25, so as to reduce the generation of an extra independent control logic, thereby reducing the complexity of the circuit.

The working principle is as follows: a user injects a water flow into the liner 11. To meet the long-term low-temperature water bath requirement, the controller 12 controls the four-way valve tube 21 to enter the ice-making state, and in this case, the compressor 2 is started, such that the refrigerant is compressed to a high-temperature and high-pressure state and flows to the port C through the port D of the four-way valve tube 21 and enters the air-cooled condenser 22. By exchanging heat by means of the fan on the air-cooled condenser 22 and ambient air, the refrigerant is condensed into a liquid and enters the capillary tube 23 to be further throttled and expanded to form a low-pressure gas, such that the temperature is further decreased. Then, the refrigerant respectively enters the heat exchanger 24 and the wall-attached D-shaped copper tube 26, and returns to the compressor 2 through the main pipe of the refrigerant outlet of the heat exchanger 24 via the ports E and S in the four-way valve tube 21 to achieve circular refrigeration and heat exchange. On the one hand, the water flow is pumped to the heat exchanger 24 from the water outlet pipe 3 through the water circulation system 5 to neutralize the refrigerant for heat exchange to achieve a direct cooling effect. On the other hand, because the wall-attached D-shaped copper tube 26 continuously contacts the surface of the liner 11, the cooled water flow in the liner 11 is continuously subjected to the heat exchange action of the wall-attached D-shaped copper tube 26 to form the ice layer. Because the water flow in the liner 11 flows circularly between the water outlet pipe 3 and the water inlet 42, the water flow in the liner 11 is relatively stable, such that the ice layer is stably formed on the inner wall of the liner 11;

After the water temperature sensor 14 detects the preset water temperature, under the action of the timer, the compressor 2 enters the delayed operation state by means of the controller 12, such that formation of the ice layer on the inner wall of the liner 11 is further stabilized. Subsequently, after reaching the timed time, the controller 12 controls the four-way valve tube 21 to enter the deicing state, the pipeline where the electromagnetic valve 25 is located is closed, and in this case, the refrigerant is compressed by the compressor 2 to a high-temperature and high-pressure state, flows to the port E through the port D in the four-way valve tube 21, and directly enters the heat exchanger 24. In this case, the ice-water mixture only enters the heat exchanger 24 through the water circulation system 5 and exchanges heat with the high-temperature and high-pressure refrigerant, such that the temperature of the ice-water mixture is increased, and the temperature of the refrigerant is decreased. After being further cooled by the capillary tube 23, the mixture returns to the compressor 2 through the ports C to S in the four-way valve tube 21 for circulation. Because the refrigerant does not enter the wall-attached D-shaped copper tube 26 during the process, the outer wall of the liner 11 and the insulation material 13 are prevented from being thermally damaged by the high-temperature and high-pressure refrigerant, such that the service life of the shell 1 is prolonged. Moreover, because the ice-water mixture circularly enters the heat exchanger 24, the uniform temperature rise of the water flow is improved, which is beneficial to peeling off part of the ice layer adhered to the inner wall of the liner 11 effectively.

Figure 5:
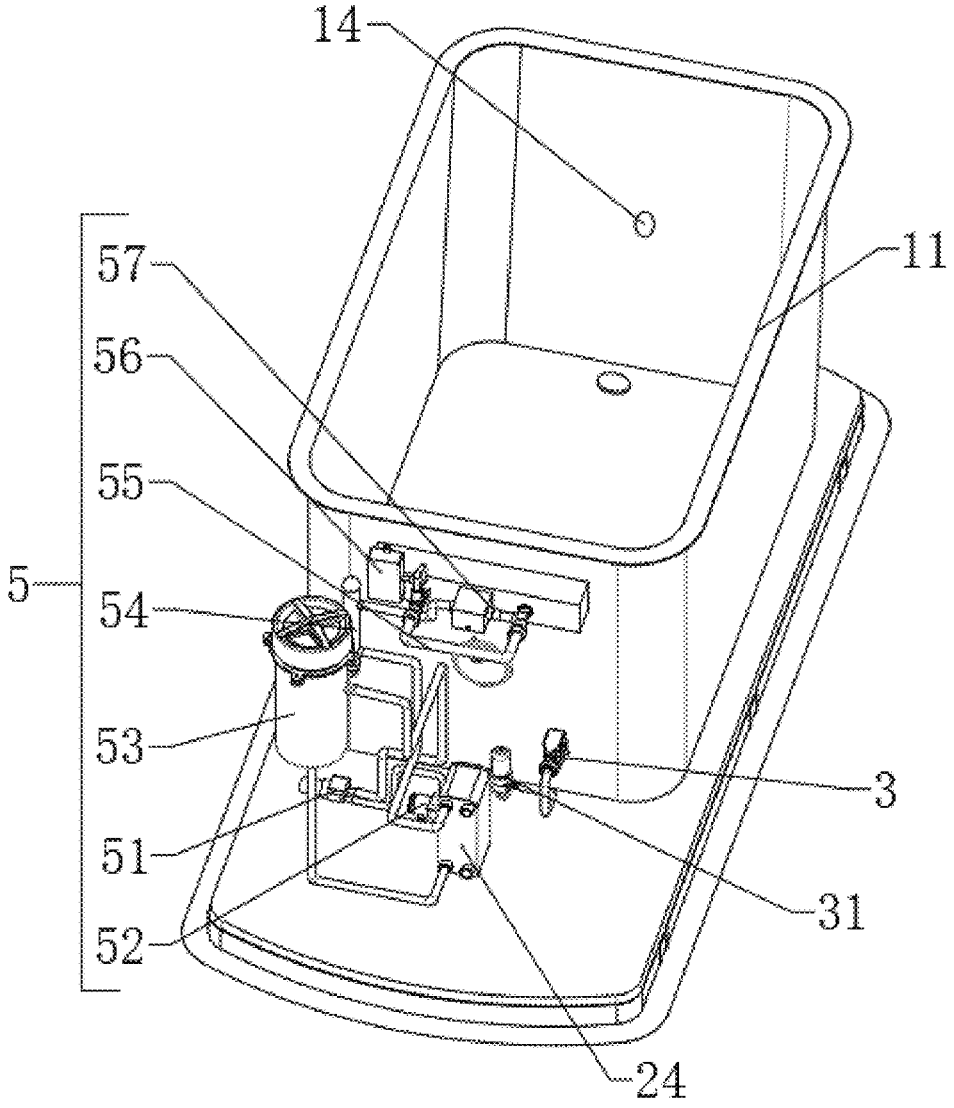
FIG. 5 is a three-dimensional schematic structural diagram of a water circulation system of the present disclosure.

Embodiment II: referring to FIG. 5, in this solution, the water circulation system 5 includes a water pump 51 and an auxiliary pump 52 mounted inside the mounting chamber 15, the water pump 51 and the auxiliary pump 52 are connected in series, a water inlet end of the auxiliary pump 52 is communicated to the water outlet pipe 3, and a clamp-type joint is used at a connection to facilitate subsequent disassembly and maintenance; a water outlet end of the water pump 51 is communicated to a secondary filter 53 through a pipeline, the secondary filter 53 is vertically mounted on the side wall of the mounting chamber 15, a filter cartridge may be detached and replaced from the top, a water outlet end of the secondary filter 53 is communicated to a water inlet end of the heat exchanger 24, a water outlet end of the heat exchanger 24 is communicated to an ultraviolet disinfection lamp 54 through a pipeline, a water outlet end of the ultraviolet disinfection lamp 54 is communicated to a three-way tube 55, one end of the three-way tube 55 is communicated to the water inlet 42 through an ozone generator 56, and the other end of the three-way tube 55 is communicated to the fog discharge port 41 through a fog generator 57.

By means of the action of the water circulation system 5, the water flow in the liner 11 circularly flows in a bottom-out and top-in manner and is purified by matching the hairnet-type filter 31, the secondary filter 53, the three-way tube 55, and the like, thereby improving the bathing cleanliness and reducing the damage to the elements during circulation. By means of the action of the fog generator 57, water spray may be formed on the surface of the water flow of the liner 11, such that the decreasing rate of the water surface temperature is further accelerated by means of water mist while the experience feeling is improved, and the formation speed of the ice layer is accelerated.

Referring to FIG. 5, a flowmeter is arranged in a pipeline at the water outlet of the water pump 51, and the flowmeter is in signal connection to the controller 12.

By means of the action of the flowmeter, the flow rate of the water circulation is determined, and the starting condition of the ice-making/deicing state is further limited, i.e., during ice-making/deicing, the water flow is pressurized by means of the auxiliary pump 52 to increase the flow rate, such that the ice-making/deicing rate is increased. Moreover, the flowmeter may be independently monitored as well. Under the action of a small flow, disinfection and fog generation may be performed on the water flow without ice-making or deicing operation, such that functional selection of the bathtub under different requirements can be achieved.

Referring to FIG. 4 and FIG. 5, the fog generator 57 is fixed in a groove inside the mounting box 4, the groove is communicated to an interior of the liner 11, and the groove is located below a water line.

By forming the groove, the fog generator 57 contacts the water flow inside the liner 11. Because this fog generator 57 adopts an ultrasonic vibration fog-making principle, the heat of the fog generator 57 can be absorbed by means of the water flow, thereby avoiding burnout of the fog generator 57 due to long-term operation.

Referring to FIG. 4, an indicator lamp 6 is mounted on the inner wall of the liner 11 below the mounting box 4, the indicator lamp 6 is in signal connection to the controller 12, and the controller 12 may be in signal connection to a mobile phone APP terminal, such that the degree of intelligent control of the indicator lamp 6 is improved, control and Use of a battery-operated remote control are avoided, and the ease of use is improved.

The indicator lamp 6 is a sanus per aquam (SPA) lamp. The light brightness may be directly controlled by a mobile phone communication terminal, to improve the user experience and atmosphere of the bathtub in the operating state.

By means of color changes of the indicator lamp 6, the operating state of the bathtub is determined, where the operating state includes an ice-making and disinfection state, a deicing and disinfection state, and a single disinfection state.

The working principle is as follows: the water pump 51 is started, such that the water flow in the liner 11 enters the hairnet-type filter 31 via the water outlet pipe 3 for filtering, subsequently enters the secondary filter 53 via the auxiliary pump 52 and the water pump 51 for further filtering, and flows into the ultraviolet disinfection lamp 54 through the heat exchanger 24 for disinfection. A part of the water flow flows through the ozone generator 56 for further disinfection and enters the liner 11 via the water inlet 42, and the other part of the water flow flows through the fog generator 57 to make water mist, which is discharged into the liner 11 via the fog discharge port 41 and is diffused on the water surface of the liner 11;

when the water pump 51 and the auxiliary pump 52 are started synchronously, the water pressure and the flow rate are increased, such that the compressor 2 can be started and adjusted, allowing the bathtub to enter the ice-making/deicing state and avoiding frequent entry into the ice-making/deicing state due to temperature monitoring by a single water temperature sensor 14. Thus, the energy consumption is reduced, and the multi-mode operation effect of the bathtub is improved.

The technical scope of the present disclosure is not limited to the content in the above description. Those of ordinary skill in the art can make various variations and modifications to the above embodiments without departing from the technical concept of the present disclosure, and all such variations and modifications shall fall within the protection scope of the present disclosure.

What is claimed is:

1. An ice-making intelligent bathtub, comprising a shell, wherein a liner is embedded at one side of a top end of the shell, a wall-attached D-shaped copper tube is adhered to an outer wall of the liner, an electromagnetic valve is mounted at one end of the wall-attached D-shaped copper tube, a mounting chamber is arranged on one side inside the shell away from the liner, a compressor is mounted inside the mounting chamber, the compressor is communicated to a port D in a four-way valve tube through a pipeline, a port S in the four-way valve tube is communicated to a return flow port of the compressor through a pipeline, a port C of the four-way valve tube is communicated to an air-cooled condenser through a pipeline;

the air-cooled condenser is communicated to a capillary tube through a pipeline, the capillary tube is communicated to a heat exchanger through a pipeline, the heat exchanger is communicated to a port E in the four-way valve tube through a pipeline, the heat exchanger and the wall-attached D-shaped copper tube are arranged in parallel, a water outlet pipe is communicated to a bottom end on one side of the liner close to the mounting chamber, a hair catcher filter is mounted on the water outlet pipe, a mounting box is mounted on an outer side of the liner above the water outlet pipe, a fog discharge port and a water inlet are respectively formed in an inner side of the mounting box, a water circulation system is arranged inside the mounting chamber to communicate with the fog discharge port, the water inlet, and the water outlet pipe, the water circulation system is connected in series to water inlet and outlet ends of the heat exchanger, a water temperature sensor is embedded onto the middle of the inner wall on one side of the liner close to the mounting chamber, a controller is mounted on an outer side of the shell, and the controller is in signal connection to the water temperature sensor, the water circulation system, the compressor, the four-way valve tube, the air-cooled condenser, the heat exchanger, and the electromagnetic valve.

2. The ice-making intelligent bathtub according to claim 1, wherein the wall-attached D-shaped copper tube is uniformly distributed in an S shape on the outer wall of the liner, and a section of the wall-attached D-shaped copper tube is D-shaped and a flattened surface of the wall-attached D-shaped copper tube fits with the liner.

3. The ice-making intelligent bathtub according to claim 1, wherein a drain pipe is arranged at a bottom end of the liner, one end of the drain pipe extends to an exterior of the shell, and a cavity between the shell and the liner is filled with an insulation material.

4. The ice-making intelligent bathtub according to claim 3, wherein the insulation material is polyurethane foam.

5. The ice-making intelligent bathtub according to claim 1, wherein a timer is arranged inside the controller for delayed operation of the compressor.

6. The ice-making intelligent bathtub according to claim 5, wherein the four-way valve tube and the electromagnetic valve are in signal linkage; in an ice-making state, a refrigerant flows from a port D to a port C in the four-way valve tube and from a port E to a port S, and the electromagnetic valve is opened; and in a deicing state, the refrigerant flows from the port D to a port E in the four-way valve tube and from a port C to a port S, and the electromagnetic valve is closed.

7. The ice-making intelligent bathtub according to claim 1, wherein the water circulation system comprises a water pump and an auxiliary pump mounted inside the mounting chamber, the water pump and the auxiliary pump are connected in series, a water inlet end of the auxiliary pump is communicated to the water outlet pipe, a water outlet end of the water pump is communicated to a secondary filter through a pipeline, a water outlet end of the secondary filter is communicated to a water inlet end of the heat exchanger, a water outlet end of the heat exchanger is communicated to an ultraviolet disinfection lamp through a pipeline, a water outlet end of the ultraviolet disinfection lamp is communicated to a three-way tube, one end of the three-way tube is communicated to the water inlet through an ozone generator, and the other end of the three-way tube is communicated to the fog discharge port through a fog generator.

8. The ice-making intelligent bathtub according to claim 7, wherein a flowmeter is arranged in a pipeline at the water outlet of the water pump, and the flowmeter is in signal connection to the controller.

9. The ice-making intelligent bathtub according to claim 7, wherein the fog generator is fixed in a groove inside the mounting box, the groove is communicated to an interior of the liner, and the groove is located below a water line.

10. The ice-making intelligent bathtub according to claim 1, wherein an indicator lamp is mounted on the inner wall of the liner below the mounting box, and the indicator lamp is in signal connection to the controller.

* * * * *